US011965682B2

(12) United States Patent
Ha et al.

(10) Patent No.: US 11,965,682 B2
(45) Date of Patent: Apr. 23, 2024

(54) AIR CONDITIONER

(71) Applicant: SAMSUNG ELECTRONICS CO., LTD., Suwon-si (KR)

(72) Inventors: Dongsu Ha, Suwon-si (KR); Donghyun Kim, Suwon-si (KR); Hyundal Kim, Suwon-si (KR); Jinwoo Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 323 days.

(21) Appl. No.: 17/574,194

(22) Filed: Jan. 12, 2022

(65) Prior Publication Data

US 2022/0186994 A1 Jun. 16, 2022

Related U.S. Application Data

(63) Continuation of application No. PCT/KR2021/017996, filed on Dec. 1, 2021.

(30) Foreign Application Priority Data

Dec. 16, 2020 (KR) ..... 10-2020-0176870

(51) Int. Cl.
*F25B 41/325* (2021.01)
*F25B 5/02* (2006.01)

(52) U.S. Cl.
CPC ..... *F25B 41/325* (2021.01); *F25B 5/02* (2013.01)

(58) Field of Classification Search
CPC ..... F25B 5/02; F25B 41/325; F25B 41/20
See application file for complete search history.

(56) References Cited

U.S. PATENT DOCUMENTS

2013/0199225 A1* 8/2013 Lee ..... F25B 30/02 62/176.1
2020/0182516 A1* 6/2020 Maruyama ..... F24F 11/81
(Continued)

FOREIGN PATENT DOCUMENTS

EP 3 521 716 A1 8/2019
JP 7-19665 1/1995
(Continued)

OTHER PUBLICATIONS

PCT/ISA/210 dated Apr. 1, 2022 in International Patent Application No. PCT/KR2021/017996 (3 pages; 4 pages English translation).

*Primary Examiner* — Lionel Nouketcha
(74) *Attorney, Agent, or Firm* — STAAS & HALSEY LLP

(57) ABSTRACT

An air conditioner includes an outdoor unit including a compressor, first and second indoor heat exchangers to receive a refrigerant from the outdoor unit, the second indoor heat exchanger receiving the refrigerant independently of the first indoor heat exchanger, and a fan disposed between the first and second indoor heat exchangers. First and second refrigerant pipes form flow paths between the outdoor unit and the first and second indoor heat exchangers. First and second expansion valves are disposed on the first and second refrigerant pipes. Third and fourth refrigerant pipes form flow paths between the compressor and the first and second indoor heat exchangers. A first opening and closing valve selectively opens and closes a fifth refrigerant pipe to selectively allow refrigerant to flow between the second and third refrigerant pipes. Second and third opening and closing valves selectively open and close the second and third refrigerant pipes.

17 Claims, 12 Drawing Sheets

(56) References Cited

U.S. PATENT DOCUMENTS

| | | | |
|---|---|---|---|
| 2021/0048233 | A1 | 2/2021 | Tanaka |
| 2021/0262703 | A1 | 8/2021 | Matsuda |

FOREIGN PATENT DOCUMENTS

| | | | |
|---|---|---|---|
| JP | 2000-274879 | | 10/2000 |
| JP | 2001-153397 | | 6/2001 |
| JP | 2001-263703 | | 9/2001 |
| JP | 2004-163052 | | 6/2004 |
| JP | 3740637 | | 2/2006 |
| JP | 3900976 | | 4/2007 |
| JP | 2008-309362 | | 12/2008 |
| JP | 2018-165587 | | 10/2018 |
| JP | 2019-109044 | | 7/2019 |
| KR | 10-2005-0086451 | A | 8/2005 |
| KR | 10-0737314 | B1 | 7/2007 |
| KR | 10-2013-0091008 | | 8/2013 |
| KR | 10-1467274 | | 12/2014 |
| WO | WO2019/163090 | | 8/2019 |

* cited by examiner

AIR CONDITIONER

CROSS REFERENCE TO RELATED APPLICATIONS

This application is a continuation application under 35 U.S.C. § 111(a) of International Application No. PCT/KR2021/017996, filed on Dec. 1, 2021, which claims priority to Korean Patent Application No. 10-2020-0176870 filed on Dec. 16, 2020. The disclosures of International Application No. PCT/KR2021/017996 and Korean Patent Application No. 10-2020-0176870 are incorporated by reference herein in their entirety.

BACKGROUND

1. Field

The disclosure relates to an air conditioner configured to heat and cool, and reheat and dehumidify, an indoor space.

2. Description of the Related Art

In general, an air conditioner is a device used for the purpose of cooling or heating an indoor space. The air conditioner circulates a refrigerant between an indoor unit and an outdoor unit so as to use characteristics of the refrigerant such that the refrigerant absorbs surrounding heat when the liquid refrigerant is vaporized, and the refrigerant emits heat to the surroundings when the refrigerant is liquefied, thereby performing a cooling operation or a heating operation.

Further, the air conditioner may perform dehumidification for absorbing moisture in air in the indoor space through heat exchange of the refrigerant. In general, the indoor dehumidification of the air conditioner is performed such that, when air cooled by a heat exchanger is circulated in the indoor space and then moved to the air conditioner, again, indoor moisture absorbed by the circulated air is transferred to the air conditioner and condensed by the heat exchanger and then the indoor moisture is removed. In this case, during the dehumidification, cold air is continuously supplied to the indoor space, and thus a difficulty in which a room temperature is unintentionally lowered may occur.

SUMMARY

Additional aspects will be set forth in part in the description which follows and, in part, will be apparent from the description, or may be learned by practice of the example embodiments One or more aspects of the disclosure relates to an air conditioner including an outdoor unit including a compressor and an outdoor heat exchanger connected to the compressor, a first indoor heat exchanger configured to receive a refrigerant from the outdoor unit, a first refrigerant pipe to form at least a portion of a first flow path between a first end of the first indoor heat exchanger and the outdoor unit, a second indoor heat exchanger configured to receive a refrigerant from the outdoor unit, independently of the first indoor heat exchanger, a second refrigerant pipe to form at least a portion of a second flow path between a first end of the second indoor heat exchanger and the outdoor unit, a fan disposed between the first indoor heat exchanger and the second indoor heat exchanger, a first expansion valve disposed on the first refrigerant pipe, a second expansion valve disposed on the second refrigerant pipe, a third refrigerant pipe to form at least a portion of a third flow path between the compressor and a second end of the first indoor heat exchanger, a fourth refrigerant pipe to form at least a portion of a fourth flow path between the compressor and a second end of the second indoor heat exchanger, a fifth refrigerant pipe, a first opening and closing valve configured to selectively open and close the fifth refrigerant pipe so as to selectively allow refrigerant to flow between the second refrigerant pipe and the third refrigerant pipe via the fifth refrigerant pipe, a second opening and closing valve configured to selectively open and close the second refrigerant pipe, and a third opening and closing valve configured to selectively open and close the third refrigerant pipe.

The second refrigerant pipe may include a first end branching from the first refrigerant pipe, a second end connected to the second heat exchanger, and the fifth refrigerant pipe branches from the second refrigerant pipe at a first connection point of the second refrigerant pipe. The second opening and closing valve may be disposed between the first end of the second refrigerant pipe and the first connection point of the second refrigerant pipe, and the second expansion valve may be disposed between the first connection point of the second refrigerant pipe and the second end of the second refrigerant pipe.

The fifth refrigerant pipe may branch from the third refrigerant pipe at a second connection point of the third refrigerant pipe. The second connection point may be disposed closer to the first indoor heat exchanger than the third opening and closing valve on the third flow path between the compressor and the second end of the first indoor heat exchanger.

The air conditioner may further include a housing configured to cover the first indoor heat exchanger, the second indoor heat exchanger, and the fan. The housing may include an inlet, a first outlet disposed adjacent to the first indoor heat exchanger, a second outlet disposed adjacent to the second indoor heat exchanger, a first blade configured to open and close the first outlet, and a second blade configured to open and close the second outlet.

The fan may be disposed between the first indoor heat exchanger and the second heat exchanger in a horizontal direction.

The fan may be a centrifugal fan including a rotating shaft formed in a vertical direction.

In response to the first opening and closing valve being closed, the second opening and closing valve and the third opening and closing valve may be opened. For example, when the air conditioner is operated in a first mode, the first opening and closing valve may be closed and the second opening and closing valve and the third opening and closing valve may be opened.

In response to the first opening and closing valve being opened, the second opening and closing valve and the third opening and closing valve may be closed. For example, when the air conditioner is operated in a second mode, the first opening and closing valve may be opened and the second opening and closing valve and the third opening and closing valve may be closed.

In response to a refrigerant flowing from the compressor to the third refrigerant pipe and the fourth refrigerant pipe, the first indoor heat exchanger and the second indoor heat exchanger may be connected in parallel to the compressor. For example, when the air conditioner is operated in a first mode, for example a heating operation, refrigerant may flow from the compressor to the third refrigerant pipe and the fourth refrigerant pipe and the first indoor heat exchanger and the second indoor heat exchanger may be connected in parallel to the compressor.

In response to a refrigerant flowing from the outdoor heat exchanger to the first refrigerant pipe and the second refrigerant pipe, the first indoor heat exchanger and the second indoor heat exchanger may be connected in parallel to the outdoor heat exchanger. For example, when the air conditioner is operated in a first mode, for example a cooling operation, refrigerant may flow from the outdoor heat exchanger to the first refrigerant pipe and the second refrigerant pipe and the first indoor heat exchanger and the second indoor heat exchanger may be connected in parallel to the outdoor heat exchanger.

In response to a refrigerant flowing from the compressor to the first refrigerant pipe and the second refrigerant pipe, a refrigerant introduced into the second indoor heat exchanger may be supplied to the second indoor heat exchanger via the fifth refrigerant pipe and the second refrigerant pipe. For example, when the air conditioner is operated in a second mode, for example a reheating and dehumidifying operation, refrigerant may flow from the compressor to the first refrigerant pipe and the second refrigerant pipe and refrigerant introduced into the second indoor heat exchanger may be supplied to the second indoor heat exchanger via the fifth refrigerant pipe and the second refrigerant pipe.

In response to a refrigerant flowing from the compressor to the first refrigerant pipe and the second refrigerant pipe, the first indoor heat exchanger and the second indoor heat exchanger may be connected in series with the compressor. For example, when the air conditioner is operated in a second mode, for example a reheating and dehumidifying operation, refrigerant may flow from the compressor to the first refrigerant pipe and the second refrigerant pipe and the first indoor heat exchanger and the second indoor heat exchanger may be connected in series with the compressor.

In response to the first opening and closing valve being closed, at least one of the first blade and the second blade may be opened.

In response to the first opening and closing valve being opened, one of the first blade and the second blade may be selectively opened. That is, one of the first blade and the second blade may be opened and the other of the first blade and the second blade may be closed.

The fan may be provided as a plurality of fans. The first indoor heat exchanger may be elongated in a first direction, and the plurality of fans may be spaced apart from each other in the first direction.

The air conditioner may further include a controller to control the first opening and closing valve, the second opening and closing valve, and the third opening and closing valve. When the air conditioner is operated in a first mode (e.g., a cooling or heating operation), the controller may be configured to close the first opening and closing valve and to open the second opening and closing valve and the third opening and closing valve. When the air conditioner is operated in a second mode (e.g., a reheating and dehumidifying operation), the controller may be configured to open the first opening and closing valve and to close the second opening and closing valve and the third opening and closing valve.

When the air conditioner is operated in the second mode and the controller opens the first opening and closing valve, the second refrigerant pipe may be connected to the third refrigerant pipe via the fifth refrigerant pipe, and the first indoor heat exchanger and the second indoor heat exchanger may be connected in series with each other.

One or more aspects of the disclosure also relates to an air conditioner including an outdoor unit including a compressor and an outdoor heat exchanger connected to the compressor, a first indoor heat exchanger configured to receive a refrigerant from the outdoor unit, a first refrigerant pipe provided to form at least a portion of a flow path connected to one end of the first indoor heat exchanger from the outdoor unit, a second indoor heat exchanger configured to receive a refrigerant from the outdoor unit, independently of the first indoor heat exchanger, a second refrigerant pipe provided to form at least a portion of a flow path connected to one end of the second indoor heat exchanger from the outdoor unit, a housing including an inlet and an outlet, and configured to cover the first indoor heat exchanger and the second indoor heat exchanger, a fan configured to introduce air to an inside of the housing through the inlet and configured to discharge air, which is introduced into the housing, through the outlet, and a bypass pipe (e.g., fifth refrigerant pipe) provided to connect the other end of the first indoor heat exchanger to the one end of the second indoor heat exchanger. The first indoor heat exchanger may be configured to condense a refrigerant flowing inside the first indoor heat exchanger, the second indoor heat exchanger may be configured to vaporize a refrigerant flowing in the second indoor heat exchanger, and the outlet may be provided to allow air, in which air heat-exchanged with the first indoor heat exchanger and air heat-exchanged with the second indoor heat exchanger are mixed with each other, in the housing to be discharged.

The air conditioner may further include an opening and closing valve configured to selectively open and close the bypass pipe (e.g., fifth refrigerant pipe). The first indoor heat exchanger and the second indoor heat exchanger may be selectively connected in parallel or in series with the outdoor unit depending on an open or closed state of the opening and closing valve.

The outlet may include a first outlet disposed adjacent to the first indoor heat exchanger and a second outlet disposed adjacent to the second indoor heat exchanger. The housing may further include a first blade configured to open and close the first outlet and a second blade configured to open and close the second outlet. In response to the opening and closing valve being opened, the first blade and the second blade may be selectively opened or closed. For example, the first blade may be in the opened position while the second blade may be in the closed position, or vice versa.

In response to the opening and closing valve being closed, at least one of the first blade and the second blade may be opened or closed. For example, the first blade may be in the opened position while the second blade may be in the closed position, or vice versa. For example, both the first blade and the second blade may be in the opened position.

One or more aspects of the disclosure also relate to an air conditioner including an outdoor unit including a compressor and an outdoor heat exchanger connected to the compressor, a first indoor heat exchanger configured to receive a refrigerant from the outdoor unit, a first refrigerant pipe provided to form at least a portion of a flow path connected to one end of the first indoor heat exchanger from the outdoor unit, a second indoor heat exchanger configured to receive a refrigerant from the outdoor unit, independently of the first indoor heat exchanger, a second refrigerant pipe provided to form at least a portion of a flow path connected to one end of the second indoor heat exchanger from the outdoor unit, a turbo fan arranged between the first indoor heat exchanger and the second indoor heat exchanger, a first expansion valve disposed on the first refrigerant pipe, a second expansion valve disposed on the second refrigerant pipe, a bypass pipe (e.g., fifth refrigerant pipe) provided to connect the other end of the first indoor heat exchanger to the one end of the first indoor heat exchanger, a first opening and closing valve configured to selectively open and close the bypass pipe (e.g., fifth refrigerant pipe), and a second opening and closing valve configured to selectively open and close the second refrigerant pipe. The first opening and closing valve and the second opening and closing valve are opened and closed oppositely. That is, when the first opening and closing valve is opened the second opening and closing valve is closed, and when the first opening and closing valve is closed the second opening and closing valve is opened.

BRIEF DESCRIPTION OF THE DRAWINGS

The above and other aspects, features, and advantages of example embodiments of the disclosure will be more apparent from the following description taken in conjunction with the accompanying drawings, in which.

DETAILED DESCRIPTION

Figure 1:
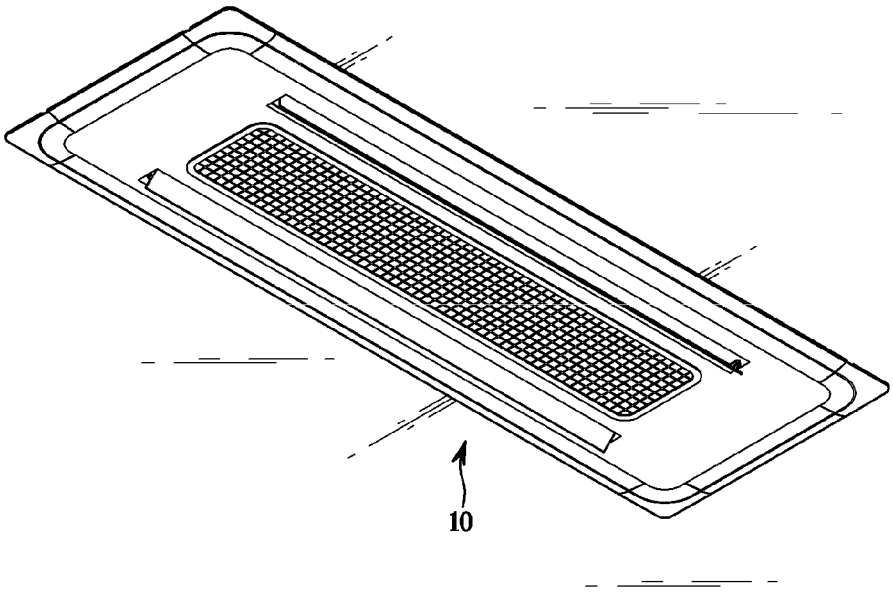
FIG. 1 is a perspective view of an indoor unit of an air conditioner according to an embodiment of the disclosure.

Embodiments described in the disclosure and configurations shown in the drawings are merely examples of the embodiments of the disclosure, and may be modified in various different ways to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element.

The terms "vertical direction", "lower side", "front and rear direction" and the like used in the following description are defined based on the drawings, and the shape and position of each component is not limited by these terms.

Descriptions shall be understood as to include any and all combinations of one or more of the associated listed items when the items are described by using the conjunctive term "and/or," or the like. That is, the term "and/or" includes a plurality of combinations of relevant items or any one item among a plurality of relevant items. Thus, the scope of the expression or phrase "A and/or B" includes all of the following: (1) the item "A", (2) the item "B", and (3) the combination of items "A and B".

In addition, the scope of the expression or phrase "at least one of A and B" is intended to include all of the following: (1) at least one of A, (2) at least one of B, and (3) at least one A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

When it is stated in the disclosure that one element is "connected to" or "coupled to" another element, the expression encompasses an example of a direct connection or direct coupling, as well as a connection or coupling with another element interposed therebetween.

One or more aspects of the disclosure are directed to providing an air conditioner capable of performing a cooling operation and a heating operation, and further to an air conditioner capable of performing indoor dehumidification while maintaining a room temperature.

According to examples disclosed herein, an air conditioner may perform cooling and heating operations, and a reheating and dehumidifying operation, through a single indoor unit because a plurality of heat exchangers configured to receive a refrigerant independently of each other is arranged and an additional refrigerant flow path, provided to selectively connect each of the heat exchangers, is formed in the single indoor unit.

Hereinafter embodiments of the disclosure will be described in detail with reference to the accompanying drawings.

Figure 2:
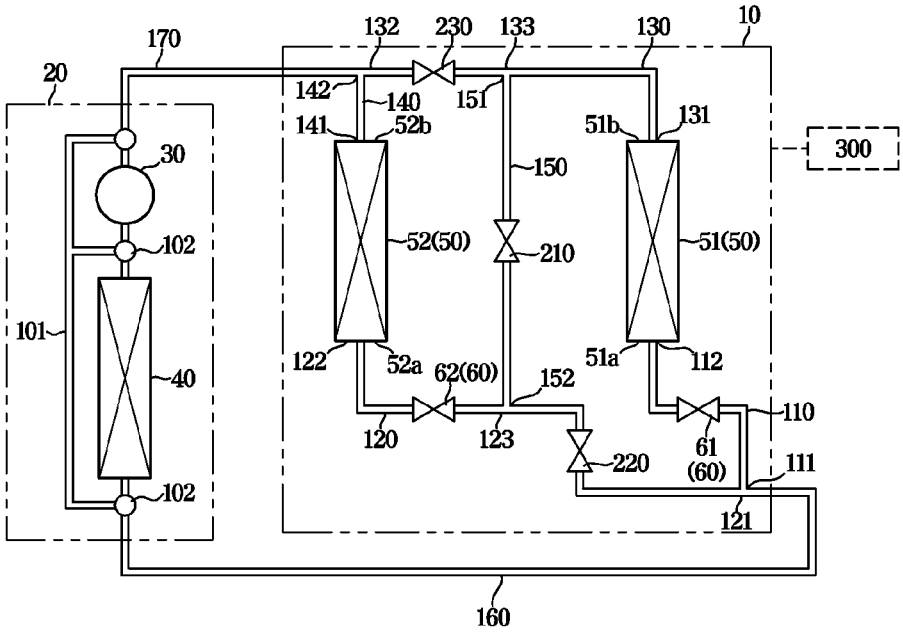
FIG. 2 is a diagram schematically illustrating a configuration of the air conditioner according to an embodiment of the disclosure.
Figure 3:
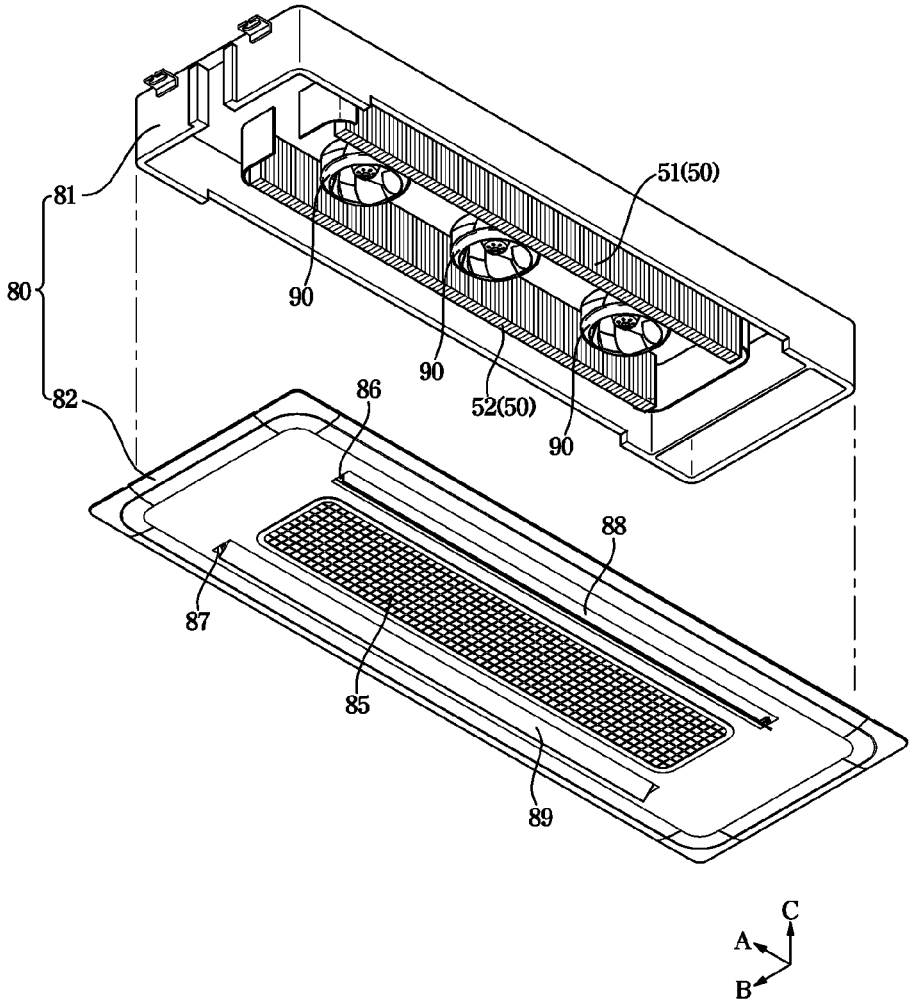
FIG. 3 is a view illustrating an inside of the indoor unit of the air conditioner according to an embodiment of the disclosure.

FIG. 1 is a perspective view of an indoor unit of an air conditioner according to an embodiment of the disclosure, FIG. 2 is a diagram schematically illustrating a configuration of the air conditioner according to an embodiment of the disclosure, and FIG. 3 is a view illustrating an inside of the indoor unit of the air conditioner according to an embodiment of the disclosure.

A refrigeration cycle forming an air conditioner 1 may include a compressor 30, a condenser, an expansion valve 60, and an evaporator. The refrigeration cycle circulates through a series of processes including compression-condensation-expansion-evaporation and may supply conditioned air that exchanges heat with a refrigerant.

The compressor 30 compresses refrigerant gas into a high-temperature and high-pressure state and discharges the high-temperature and high-pressure refrigerant gas. The discharged refrigerant gas flows into the condenser. The condenser condenses the compressed refrigerant into a liquid state, and the refrigerant radiates heat to the surroundings through a condensation process.

The expansion valve 60 expands the high-temperature and high-pressure liquid refrigerant, which is condensed in the condenser, into a low-pressure liquid refrigerant. The expansion valve 60 may be composed of a capillary tube. The evaporator evaporates the refrigerant expanded in the expansion valve, and returns the refrigerant gas in the low-temperature and low-pressure state to the compressor. The evaporator may obtain the refrigeration effect through the heat exchange with an object to be cooled by using the latent heat of evaporation of the refrigerant. By virtue of the refrigeration cycle, the air conditioner 1 may control a temperature of an indoor space.

The condenser and evaporator may be provided as heat exchangers 40 and 50. The heat exchanger 40 may be distinguished into an outdoor heat exchanger 40 and an indoor heat exchanger 50. A function of each of the heat exchangers 40 and 50 may be changed between the condenser and the evaporator according to a direction, in which a refrigerant flows, and thus the heat exchangers 40 and 50 may perform condensation and evaporation of the refrigerant.

An outdoor unit 20 of the air conditioner 1 may include the compressor 30 and the outdoor heat exchanger 40. An indoor unit 10 of the air conditioner 1 may include the indoor heat exchanger 50. The expansion valve 60 may be included in any one of an indoor unit 10 and an outdoor unit 20. According to an embodiment, the expansion valve 60 may be arranged in the indoor unit 10. However, it is not limited thereto, and thus the expansion valve 60 may be arranged in the outdoor unit 20 or an outside of the indoor unit 10.

As mentioned above, the indoor heat exchanger 50 and the outdoor heat exchanger 40 may serve as the condenser and the evaporator. When the indoor heat exchanger 50 serves as the condenser, the air conditioner 1 may serve as a heater, and when the indoor heat exchanger 50 serves as the evaporator, the air conditioner 1 may serve as a cooler.

The indoor unit 10 of the air conditioner 1 may include a housing 80 provided to form an exterior. The housing 80 of the indoor unit 10 may be installed to be embedded in a ceiling.

Unlike an indoor unit of a wall-mounted type or packaged type air conditioner, the indoor unit 10 of the ceiling-type air conditioner is installed in a state of being embedded in the ceiling, and thus the utilization of the indoor space may be increased. In this example, the ceiling-type air conditioner is described as an example, but the spirit of the disclosure may not be limited thereto.

The housing 80 may include an upper housing 81 and a lower housing 82. The upper housing 81 may be provided to cover the indoor heat exchanger 50. The lower housing 82 may be arranged on a bottom surface (side) of the upper housing 81.

The indoor unit 10 may include the indoor heat exchanger 50 as described above. The indoor heat exchangers 50 may be provided as a plurality of indoor heat exchangers. The air conditioner 1 according to an embodiment of the disclosure may include a first indoor heat exchanger 51 and a second indoor heat exchanger 52.

The indoor unit 10 may include a fan 90 configured to suck indoor air into the indoor unit 10. The fan 90 may be configured to allow air introduced into the indoor unit 10 by the fan 90 to exchange heat with the indoor heat exchangers 51 and 52 and to discharge the air heat-exchanged to the outside of the indoor unit 10. The fan 90 may be provided as a plurality of fans.

The first indoor heat exchanger 51 and the second indoor heat exchanger 52 may be arranged approximately parallel to each other. The first indoor heat exchanger 51 and the second indoor heat exchanger 52 may be provided to have longitudinal axes extending in a first direction A, respectively.

The plurality of fans 90 may be arranged between the first indoor heat exchanger 51 and the second indoor heat exchanger 52, respectively. The plurality of fans 90 may be arranged between the first indoor heat exchanger 51 and the second indoor heat exchanger 52 in a second direction B perpendicular to the first direction A.

The plurality of fans 90 may be spaced apart from each other in the first direction A.

The fan 90 may be provided as a centrifugal fan. For example, the fan 90 may be formed as a turbofan. A rotating shaft of the fan 90 may be provided to extend in a third direction C perpendicular to the first and second directions A and B, or, in other words, in a vertical direction of the indoor unit 10.

Accordingly, the fan 90 may be configured to suck air from the third direction C and move the air to the first and second directions A and B that corresponds to a circumferential direction of the fan 90.

The expansion valve 60 may include a first expansion valve 61 connected to the first indoor heat exchanger 51 and a second expansion valve 62 connected to the second indoor heat exchanger 52.

The housing 80 may include an inlet 85 and outlets 86 and 87 formed in the lower housing 82.

The inlet 85 may be formed between the first indoor heat exchanger 51 and the second indoor heat exchanger 52 in the second direction B. The inlet 85 may be arranged under the fan 90 in the third direction C. Air may be sucked into the indoor unit 10 through the inlet 85 formed on the bottom surface of the housing 10.

The outlets 86 and 87 may be provided on opposite outer sides of the inlet 85 in the second direction B, respectively. The outlets 86 and 87 may include a first outlet 86 and a second outlet 87. As illustrated in FIG. 3, the outlets 86 and 87 may extend longitudinally in the first direction A.

The first outlet 86 may be arranged adjacent to the first indoor heat exchanger 51. The second outlet 87 may be arranged adjacent to the second indoor heat exchanger 52.

The housing 80 may include blades 88 and 89 configured to open and close the first outlet 86 and the second outlet 87.

The blades 88 and 89 may include a first blade 88 configured to open and close the first outlet 86 and a second blade 89 configured to open and close the second outlet 87.

When each of the blades 88 and 89 is arranged in a closed position for closing each of the outlets 86 and 87, air may not be discharged from the indoor unit 10 through the each of outlets 86 and 87.

When the each of the blades 88 and 89 is arranged in an open position for opening each of the outlets 86 and 87, air may be discharged from the indoor unit 10 through the each of outlets 86 and 87.

In addition, when each of the blades 88 and 89 is arranged in the open position, a direction of the air discharged from each of the outlets 86 and 87 may be variously guided according to an angle at which the each of blades 88 and 89 is arranged.

The air conditioner 1 may include refrigerant pipes 110, 120, 130, 140, 150, 160 and 170 provided to allow the refrigerant to flow to each component.

The refrigerant pipes 110, 120, 130, 140, 150, 160 and 170 may include a first connection pipe 160 and a second connection pipe 170 provided to allow the refrigerant to flow between the indoor unit 10 and the outdoor unit 20

One end of the first connection pipe 160 may be selectively connected to one of the outdoor heat exchanger 40 and the compressor 30, and the other end of the first connection pipe 160 may be connected to an inside of the indoor unit 10. The other end of the first connection pipe 160 may be connected to a first refrigerant pipe 110 and a second refrigerant pipe 120 described later.

One end of the second connection pipe 170 may be connected to the compressor 30, and the other end of the second connection pipe 170 may be connected to the inside of the indoor unit 10. The other end of the second connection pipe 170 may be connected to a third refrigerant pipe 130 and a fourth refrigerant pipe 140 described later.

Although not shown in detail in the drawings, a plurality of refrigerant flow paths 101 and a plurality of valves 102 are provided among the compressor 30, the outdoor heat exchanger 40, the first connection pipe 160 and the second connection pipe 170.

Depending on opening and closing directions of the plurality of valves 102, the refrigerant discharged from the compressor 30 or the refrigerant discharged from the outdoor heat exchanger 40 may be selectively moved into the first connection pipe 160 or the refrigerant discharged from the compressor 30 may be moved to the second connection pipe 170.

That is, through a plurality of opening and closing combinations, the plurality of refrigerant flow paths 101 and the plurality of valves 102 may be operated to allow the refrigerant discharged from the compressor 30 or the outdoor heat exchanger 40 to be selectively introduced into the one end of the first connection pipe 160 through the plurality of refrigerant flow paths 101 and the plurality of valves 102. In addition, the plurality of refrigerant flow paths 101 and the plurality of valves 102 may be operated to allow the refrigerant discharged from the compressor 30 to be selectively introduced into the one end of the second connection pipe 170 through the plurality of refrigerant flow paths 101 and the plurality of valves 102. Hereinafter the operation of the plurality of refrigerant flow paths 101 and the plurality of valves 102 will be omitted.

In response to the indoor unit 10 being operated in a cooling mode, the refrigerant may be discharged from the outdoor heat exchanger 40 and introduced into the indoor unit 10 through the first connection pipe 160, and then introduced into the outdoor unit 20 through the second connection pipe 170.

Conversely, in response to the indoor unit 10 being operated in a heating mode, the refrigerant may be discharged from the compressor 30 and introduced into the indoor unit 10 through the second connection pipe 170, and then introduced into the outdoor unit 20 through the first connection pipe 160.

The refrigerant pipes 110, 120, 130, 140, 150, 160 and 170 may include the first refrigerant pipe 110 provided to transfer the refrigerant, which flows through the first connection pipe 160, to the first indoor heat exchanger 51, and the second refrigerant pipe 120 provided to transfer the refrigerant, which flows through the first connection pipe 160, to the second indoor heat exchanger 52.

The first refrigerant pipe 110 and the second refrigerant pipe 120 may be formed as a partial region of the first connection pipe 160, but for convenience of description, each configuration will be described separately.

That is, the first refrigerant pipe 110 or the second refrigerant pipe 120 may be formed as a partial pipe of the first connection pipe 160, and the second refrigerant pipe 120 or the first refrigerant pipe 110 may be provided as a pipe branching from the first connection pipe 160.

The first refrigerant pipe 110 and the second refrigerant pipe 120 may be arranged inside the indoor unit 10.

One end 111 of the first refrigerant pipe 110 may be connected to the other end of the first connection pipe 160, and the other end 112 of the first refrigerant pipe 110 may be connected to one end 51*a* of the first indoor heat exchanger 51. The first expansion valve 61 may be provided on the first refrigerant pipe 110.

One end 121 of the second refrigerant pipe 120 may be connected to the other end of the first connection pipe 160, and the other end 122 of the second refrigerant pipe 120 may be connected to one end 52*a* of the second indoor heat exchanger 52. The second expansion valve 62 may be provided on the second refrigerant pipe 120.

When the refrigerant is discharged from the outdoor heat exchanger 40 and introduced into the indoor unit 10 through the first connection pipe 160, the first indoor heat exchanger 51 and the second indoor heat exchanger 52 may be connected in parallel to the outdoor unit 20 through the first refrigerant pipe 110 and the second refrigerant pipe 120. For example, the first indoor heat exchanger 51 and the second indoor heat exchanger 52 may be connected in parallel to the outdoor heat exchanger 40.

However, the first heat exchanger 51 and the second heat exchanger 52 may be selectively connected in parallel or in series with the outdoor unit 20 by a fifth refrigerant pipe 150 described later.

The refrigerant pipes 110, 120, 130, 140, 150, 160 and 170 may include the third refrigerant pipe 130 provided to transfer the refrigerant, which is discharged from the compressor 30 and flows through the second connection pipe 170, to the first indoor heat exchanger 51, and the fourth refrigerant pipe 140 provided to transfer the refrigerant, which is discharged from the compressor 30 and flows through the second connection pipe 170, to the second indoor heat exchanger 52.

Conversely, the third refrigerant pipe 130 may be provided to allow the refrigerant, which is discharged from the first indoor heat exchanger 51, to flow to the second connection pipe 170. In addition, the fourth refrigerant pipe 140 may be provided to allow the refrigerant, which is discharged from the second indoor heat exchanger 52, to flow to the second connection pipe 170.

The third refrigerant pipe 130 and the fourth refrigerant pipe 140 may be formed as a partial region of the second connection pipe 170, but for convenience of description, each configuration will be described separately.

The third refrigerant pipe 130 or the fourth refrigerant pipe 140 may be formed as a partial pipe of the second connection pipe 170, and the fourth refrigerant pipe 140 or the third refrigerant pipe 130 may be provided as a pipe branching from the second connection pipe 170.

The third refrigerant pipe 130 and the fourth refrigerant pipe 140 may be arranged inside the indoor unit 10.

One end 131 of the third refrigerant pipe 130 may be connected to the other end 51*b* of the first indoor heat exchanger 51, and the other end 132 of the third refrigerant pipe 130 may be connected to the other end of the second connection pipe 170.

One end 141 of the fourth refrigerant pipe 140 may be connected to the other end 52*b* of the second indoor heat exchanger 52, and the other end 142 of the fourth refrigerant pipe 140 may be connected to the second connection pipe 170.

The refrigerant pipes 110, 120, 130, 140, 150, 160 and 170 may include the fifth refrigerant pipe 150 provided to connect the other end 51*b* of the first indoor heat exchanger 51 to the one end 52*a* of the second indoor heat exchanger 52.

The fifth refrigerant pipe 150 may be provided to allow a portion of the refrigerant, which is discharged from the other end 51*b* of the first indoor heat exchanger 51, to be introduced into the one end 52*a* of the second indoor heat exchanger 52.

For example, the fifth refrigerant pipe 150 may include one end 151 connected to the third refrigerant pipe 130 connected to the other end 51*b* of the first indoor heat exchanger 51, and the other end 152 connected to the second refrigerant pipe 120 connected to the one end 52*a* of the second indoor heat exchanger 52.

The air conditioner 1 may include a first opening and closing valve 210 provided on the fifth refrigerant pipe 150. The first opening and closing valve 210 may selectively open and close the flow of the refrigerant from the other end 51*b* of the first indoor heat exchanger 51 to the one end 52*a* of the second indoor heat exchanger 52, on the fifth refrigerant pipe 150.

The air conditioner 1 may include a second opening and closing valve 220 provided on the second refrigerant pipe 120. The second opening and closing valve 220 may selectively block the flow of the refrigerant on the second refrigerant pipe 120 through the second opening and closing valve 220 with respect to the second opening and closing valve 220.

When it is assumed that a point connected to the fifth refrigerant pipe 150 in the second refrigerant pipe 120 is a first connection point 123, the second opening and closing valve 220 may be arranged between the one end 121 and the first connection point 123 of the second refrigerant pipe 120.

The air conditioner 1 may include a third opening and closing valve 230 provided on the third refrigerant pipe 130. The third opening and closing valve 230 may selectively block the flow of the refrigerant on the third refrigerant pipe 130 through the third opening and closing valve 230 with respect to the third opening and closing valve 230.

When it is assumed that a point connected to the fifth refrigerant pipe 150 in the third refrigerant pipe 130 is a second connection point 133, the third opening and closing valve 230 may be arranged between the other end 132 and the second connection point 133 of the third refrigerant pipe 130.

The air conditioner 1 may include a controller 300 configured to control the operation of the opening and closing valves 210, 220, 230 and the blades 88 and 89.

The controller 300 may operate the opening and closing valves 210, 220, and 230 and the blades 88 and 89 so that the opening and closing valves 210, 220, and 230 are opened and closed or the blades 88, 89 are opened and closed according to the flow direction of the refrigerant or a signal input by a user.

As for a general air conditioner, an indoor unit may be selectively used as a cooler or a heater according to an inflow direction of a refrigerant introduced into the indoor unit.

Further, through a dehumidification mode, the air conditioner may be provided to allow moisture in indoor air to be separated from air by a heat exchanger arranged inside the indoor unit.

That is, when the indoor heat exchanger of the indoor unit is operated as an evaporator, the dehumidification of the indoor air may be performed in such a way that the indoor air is circulated through the indoor unit, and as the circulated air passes through the evaporator, moisture in the air is condensed, and the condensed moisture is separated from the air and then remains in the indoor unit, and thus air, from which the moisture is removed, is introduced into the indoor space.

In this case, the indoor heat exchanger is operated as the evaporator, and thus when the indoor air is circulated through the indoor unit, low-temperature air generated from the evaporator may be supplied to the indoor space. Accordingly, when the air conditioner is operated in the dehumidification mode, a difficulty in which the room temperature is unnecessarily lowered may occur.

In order to prevent the room temperature from unnecessarily being lowered when the air conditioner is operated in the dehumidification mode, the indoor unit may be implemented to perform the indoor dehumidification through a method, that is the reheat and dehumidification mode through the indoor unit. In an example, a part of the indoor heat exchanger may serve as the evaporator to remove moisture from the air, and the other part of the indoor heat exchanger may serve as the condenser to heat the dehumidified air to discharge the heated air to the outside of the indoor unit.

However, in this case, because a part of the indoor heat exchanger is provided as the evaporator and the condenser, the refrigerant flows in only one direction, and thus it is impossible to implement an air conditioner configured to both cool and heat the indoor space.

As described above, the air conditioner 1 according to various embodiments of the disclosure is configured to perform a cooling operation and a heating operation of the indoor space and additionally configured to perform a reheating and dehumidifying operation through the indoor unit 10.

Hereinafter the operation of the air conditioner 1 will be described in detail.

First, the cooling operation and heating operation of the air conditioner 1 will be described in detail.

Figure 4:
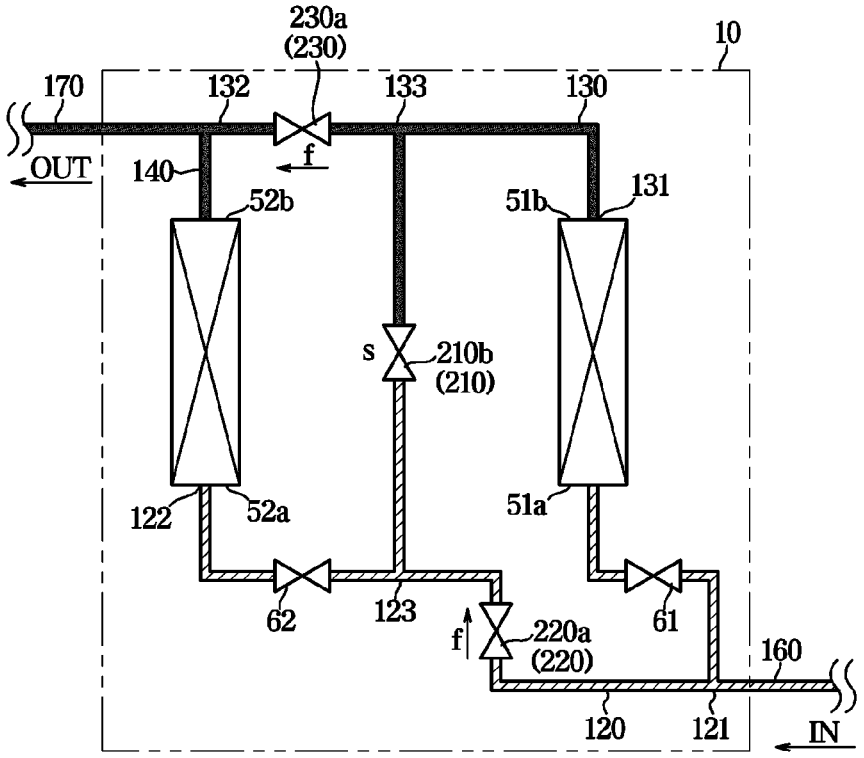
FIG. 4 is a diagram schematically illustrating a configuration of the air conditioner in a cooling operation of the air conditioner according to an embodiment of the disclosure.
Figure 5:
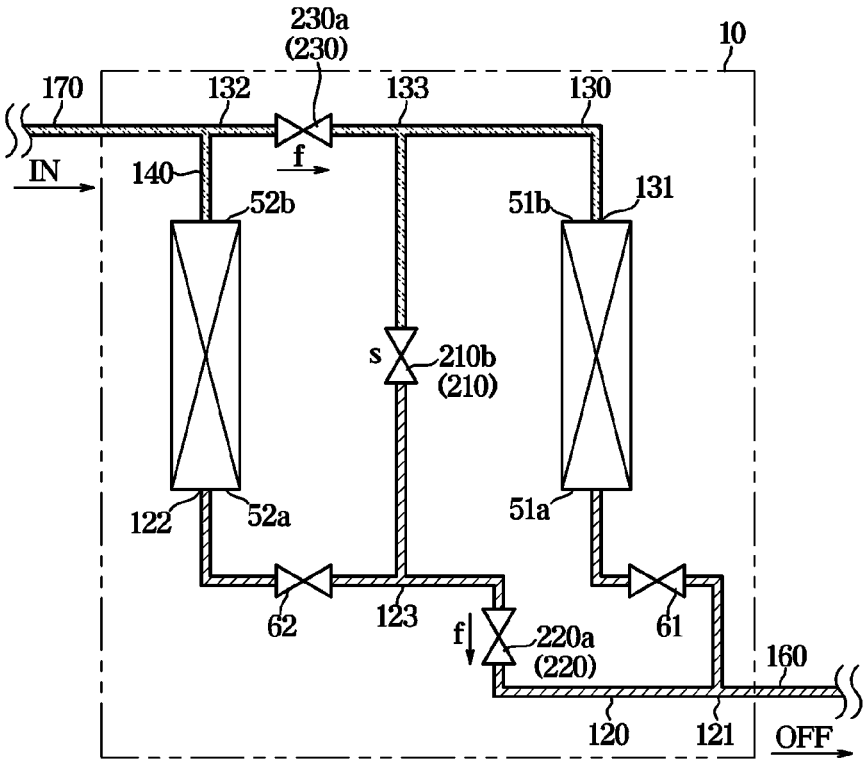
FIG. 5 is a diagram schematically illustrating a configuration of the air conditioner in a heating operation of the air conditioner according to an embodiment of the disclosure.
Figure 6:
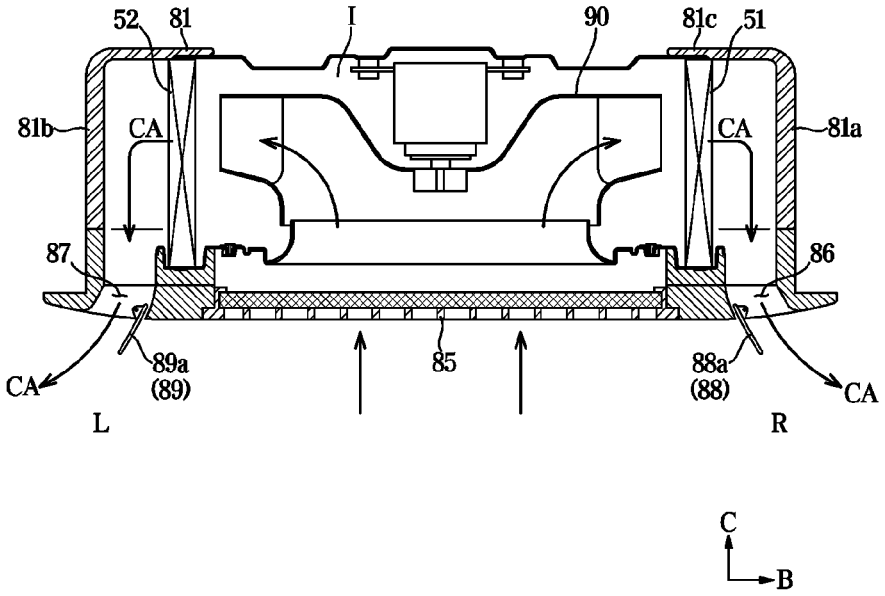
FIG. 6 is a schematic longitudinal-sectional view of the indoor unit of the air conditioner in the cooling operation of the air conditioner according to an embodiment of the disclosure.
Figure 7:
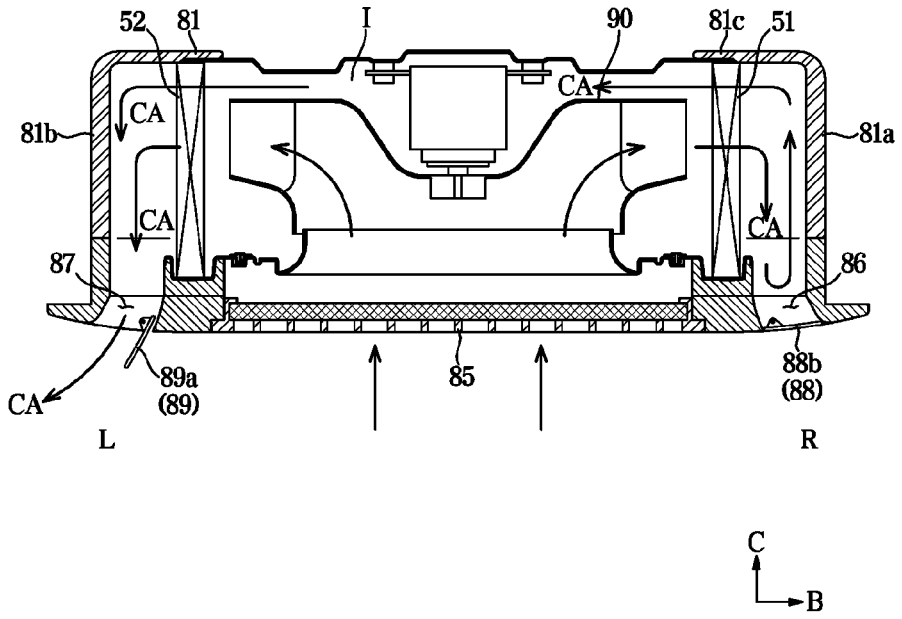
FIG. 7 is a schematic longitudinal-sectional view of the indoor unit of the air conditioner in the cooling operation of the air conditioner according to an embodiment of the disclosure.
Figure 8:
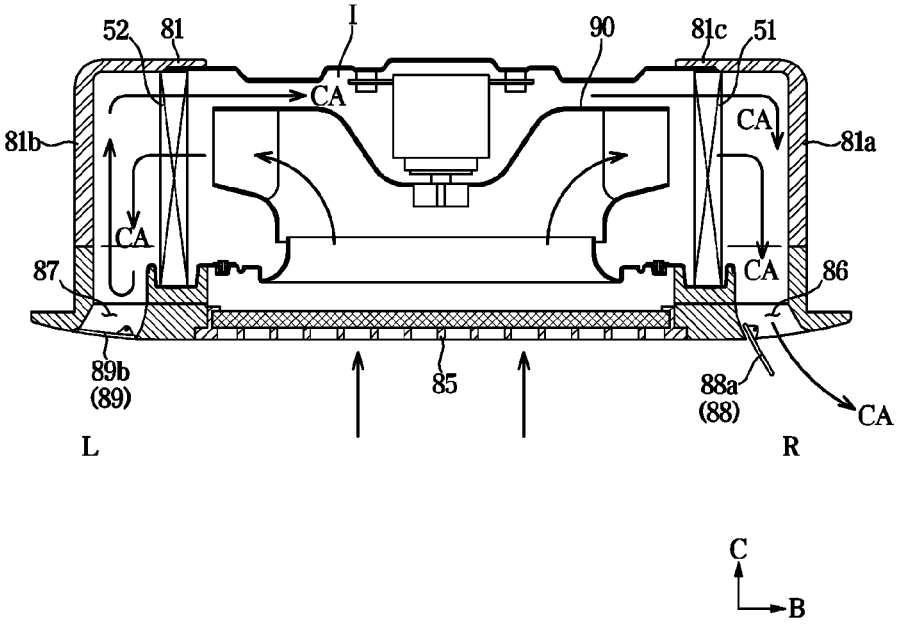
FIG. 8 is a schematic longitudinal-sectional view of the indoor unit of the air conditioner in the cooling operation of the air conditioner according to an embodiment of the disclosure.
Figure 9:
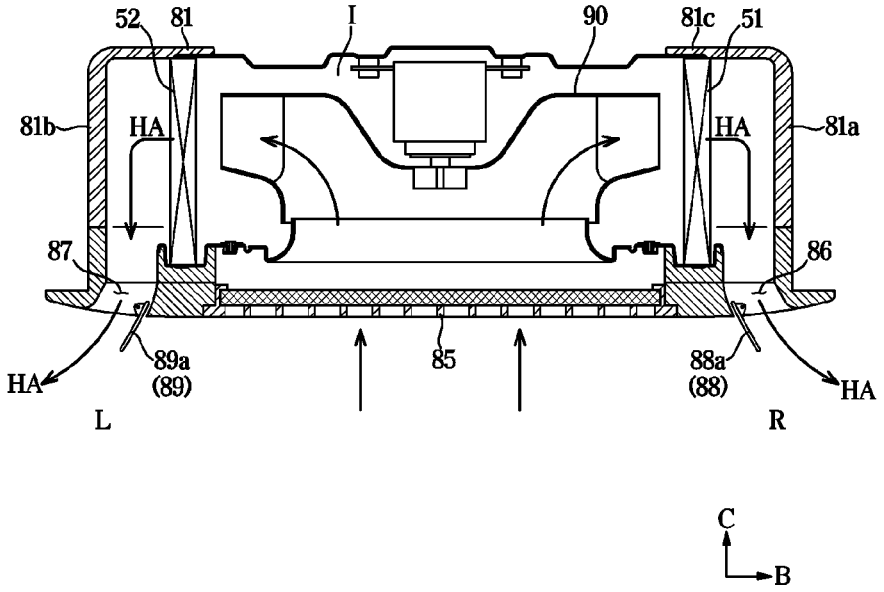
FIG. 9 is a schematic longitudinal-sectional view of the indoor unit of the air conditioner in the heating operation of the air conditioner according to an embodiment of the disclosure.

FIG. 4 is a diagram schematically illustrating a configuration of the air conditioner in the cooling operation of the air conditioner according to an embodiment of the disclosure, FIG. 5 is a diagram schematically illustrating a configuration of the air conditioner in the heating operation of the air conditioner according to an embodiment of the disclosure, FIG. 6 is a schematic longitudinal-sectional view of the indoor unit of the air conditioner in the cooling operation of the air conditioner according to an embodiment of the disclosure, FIG. 7 is a schematic longitudinal-sectional view of the indoor unit of the air conditioner in the cooling operation of the air conditioner according to an embodiment of the disclosure, FIG. 8 is a schematic longitudinal-sectional view of the indoor unit of the air conditioner in the cooling operation of the air conditioner according to an embodiment of the disclosure, and FIG. 9 is a schematic longitudinal-sectional view of the indoor unit of the air conditioner in the heating operation of the air conditioner according to an embodiment of the disclosure.

As illustrated in FIG. 4, in the cooling mode of the air conditioner 1, the refrigerant may be discharged from the outdoor heat exchanger 40 and introduced into the inside of the indoor unit 10 through the first connection pipe 160.

In the cooling mode of the air conditioner 1, the controller 300 may control the opening and closing valves 210, 220, and 230 to allow the first opening and closing valve 210 to be in a closed state 210*b*, and the second opening and closing valve 220 to be in an open state 220*a*, and the third opening and closing valve 230 to be in an open state 230*a*.

Further, the controller 300 may control the plurality of flow paths and valves to allow the refrigerant discharged from the outdoor heat exchanger 40 to be introduced into the inside of the indoor unit 10 through the first connection pipe 160.

The liquid refrigerant introduced through the first connection pipe 160 may branch into the first refrigerant pipe 110 and the second refrigerant pipe 120, and flow to the first expansion valve 61 and the second expansion valve 62.

A portion of the refrigerant flowing through the second refrigerant pipe 120 may flow to the fifth refrigerant pipe 150 at the first connection point 123. However, because the first opening and closing valve 210 arranged on the fifth refrigerant pipe 150 is in the closed state 210*b*, the refrigerant may not flow to the third refrigerant pipe 130 through the fifth refrigerant pipe 150. Accordingly, all of the refrigerant introduced into the second refrigerant pipe may flow to the second expansion valve 62.

In addition, because the second opening and closing valve 220 arranged on the second refrigerant pipe 120 is in the open state 220*a*, all the refrigerant introduced from the one end 121 of the second refrigerant pipe 120 may flow (f) toward the other end 122 of the second refrigerant pipe 120.

Accordingly, the liquid refrigerant may be decompressed to a low-temperature and low-pressure state through the first expansion valve 61 and the second expansion valve 62, respectively, and introduced into the first indoor heat exchanger 51 and the second indoor heat exchanger 52 and thus a phase of the refrigerant may be converted into the gaseous refrigerant while being vaporized. At this time, low-temperature air may be provided to the indoor space by the absorbed heat.

The refrigerant that is heat-exchanged in the first indoor heat exchanger 51 and the second indoor heat exchanger 52 may flow to the second connection pipe 170 through the third refrigerant pipe 130 and the fourth refrigerant pipe 140, and then be introduced into the outdoor unit 20.

A portion of the refrigerant flowing through the third refrigerant pipe 130 may flow to the fifth refrigerant pipe 150 at the second connection point 133. However, because the first opening and closing valve 210 arranged on the fifth refrigerant pipe 150 is in the closed state 210*b*, the refrigerant may not flow to the second refrigerant pipe 120 through the fifth refrigerant pipe 150. That is, because the first opening and closing valve 210 is maintained in the closed state 210*b*, the flow of the refrigerant toward the second refrigerant pipe 120 may be stopped (s) and thus all the refrigerant introduced into the third refrigerant pipe may flow to the second connection pipe 170.

In addition, because the third opening and closing valve 230 arranged on the third refrigerant pipe 130 is in the open state 230*a*, all the refrigerant introduced from the one end 131 of the third refrigerant pipe 130 may flow (f) toward the other end 132 of the third refrigerant pipe 130.

Conversely, as illustrated in FIG. 5, in the heating mode of the air conditioner 1, the controller 300 may control the opening and closing valves 210, 220, and 230 to allow the first opening and closing valve 210 to be in the closed state 210*b*, and the second opening and closing valve 220 to be in the open state 220*a*, and the third opening and closing valve 230 to be in the open state 230*a*.

Further, the controller 300 may control the plurality of flow paths and valves to allow the refrigerant discharged from the compressor 30 to be introduced into the indoor unit 10 through the second connection pipe 170.

The gaseous refrigerant introduced through the second connection pipe 170 may branch into the third refrigerant pipe 130 and the fourth refrigerant pipe 140 and flow to the first heat exchanger 51 and the second heat exchanger 52.

Because the third opening and closing valve 230 arranged on the third refrigerant pipe 130 is in the open state 230*a*, all the refrigerant introduced from the other end 132 of the third refrigerant pipe 130 may flow (f) to the one end 131 of the third refrigerant pipe 130.

A portion of the refrigerant flowing through the third refrigerant pipe 130 may flow to the fifth refrigerant pipe 150 at the second connection point 133. However, because the first opening and closing valve 210 arranged on the fifth refrigerant pipe 150 is in the closed state 210*b*, the refrigerant may not flow to the second refrigerant pipe 120 through the fifth refrigerant pipe 150.

That is, because the first opening and closing valve 210 is maintained in the closed state 210*b*, the flow of the refrigerant toward the second refrigerant pipe 120 may be stopped (s) and thus all the refrigerant introduced into the third refrigerant pipe may flow to the one end 131 of the third refrigerant pipe 130.

The refrigerant may be introduced into the first indoor heat exchanger 51 and the second indoor heat exchanger 52 and thus a phase of the refrigerant may be converted into the liquid refrigerant while being condensed. At this time, hot air may be supplied to the indoor space by the radiated heat.

The refrigerant that is heat-exchanged in the first indoor heat exchanger 51 and the second indoor heat exchanger 52 may be decompressed to a low temperature and low-pressure state while passing through the first expansion valve 61 and the second expansion valve 62 through the first refrigerant pipe 110 and the second refrigerant pipe 120, and the refrigerant may be introduced into the first connection pipe 160 and flow to the outdoor unit 20.

At this time, because the second opening and closing valve 220 arranged on the second refrigerant pipe 120 is in the open state 220*a*, all the refrigerant introduced from the other end 122 of the second refrigerant pipe 120 may flow to the one end 121 of the second refrigerant pipe 120.

In addition, a portion of the refrigerant flowing through the second refrigerant pipe 120 may flow to the fifth refrigerant pipe 150 at the first connection point 123. However, because the first opening and closing valve 210 arranged on the fifth refrigerant pipe 150 is in the closed state 210*b*, the flow of the refrigerant that is to the third refrigerant pipe 130 through the fifth refrigerant pipe 150 may be stopped (s). Accordingly, all the refrigerant introduced into the second refrigerant pipe may flow to the first connection pipe 160 via the second expansion valve 62 and the second opening and closing valve 220.

As mentioned above, while the refrigerant flows to the indoor unit 10 through the first connection pipe 160 or the second connection pipe 170, the air conditioner 1 may perform both of the cooling mode the heating mode through the indoor unit 10.

Further, the first indoor heat exchanger 51 and the second indoor heat exchanger 52 are connected in parallel to the outdoor heat exchanger 40 or the compressor 30, and thus each of the heat exchangers 51 and 52 may be identically operated as the evaporator or the condenser.

That is, as the first refrigerant pipe 110 and the second refrigerant pipe 120 are connected in parallel to the first connection pipe 160, the first and second indoor heat exchangers 51 and 52 may be connected in parallel to the outdoor heat exchanger 40, and accordingly, the first and second indoor heat exchangers 51 and 52 may be operated as a plurality of evaporators.

Conversely, as the third refrigerant pipe 130 and the fourth refrigerant pipe 140 are connected in parallel to the second connection pipe 170, the first and second indoor heat exchangers 51 and 52 may be connected in parallel to the compressor 30, and accordingly, the first and second indoor heat exchangers 51 and 52 may be operated as a plurality of condensers.

As illustrated in FIG. 6, in the cooling operation of the air conditioner 1, the air introduced into the indoor unit 10 through the inlet 85 may flow in the inside I of the housing 80 and be heat-exchanged while passing through the second indoor heat exchanger 52, which is arranged on a left side L of the fan 90, and the first indoor heat exchanger 51, which is arranged on a right side R of the fan 90, and thus the air may be changed into low-temperature air that is cold air CA.

The left side L and the right side R illustrated in FIG. 6 are examples for easy description, and the left and right sides are not limited thereto.

The air introduced into the inside I of the upper housing 81 may flow in an inside I formed by a right wall 81*a*, a left wall 81*b*, an upper wall 81*c* and front and rear walls (not shown), and pass through the indoor heat exchangers 51 and 52, so as to be changed into cold air CA.

In response to the first and second blades 88 and 89 being arranged in open positions 88*a* and 89*a* for opening the first and second outlets 86 and 87, respectively, the cold air CA that is heat-exchanged may be discharged to the left and right side L and R of the housing 80 through the first and second outlets 86 and 87.

As described above, the fan 90 may be formed as a centrifugal fan and the fan 90 may be formed as a turbofan. In addition, the first and second indoor heat exchangers 51 and 52 may be arranged approximately symmetrically with respect to the fan 90.

Accordingly, the fan 90 may be configured to move the air to the first and second indoor heat exchangers 51 and 52 located in a direction perpendicular to an extension direction of the rotating shaft of the fan 90, so as to allow the air to be easily discharged to the first and second outlets 86 and 87.

As described above, the cold air CA may be discharged to both the left and right sides L and R of the indoor unit 10, but alternatively, according to a user selection, the indoor unit 10 may be controlled to allow the cold air to be discharged to only the left side L of the indoor unit 10, as illustrated in FIG. 7, or the indoor unit 10 may be controlled to allow the cold air to be discharged to only the right side R of the indoor unit 10, as illustrated in FIG. 8.

That is, when a user inputs a signal to the air conditioner 1 to allow the air to be discharged to only the left side L of the indoor unit 10, the controller 300 may allow the second blade 89 to be in an open position 89*a* and thus the second blade 89 may open the second outlet 87, and the controller 300 may allow the first blade 88 to be in a closed position 88*b* and thus the first blade 88 may close the first outlet 86.

At this time, the controller 300 may additionally control the first expansion valve 61 to allow the first expansion valve 61 to be closed to prevent the refrigerant from flowing into the first heat exchanger 51.

Conversely, when a user inputs a signal to the air conditioner 1 to allow the air to be discharged to only the right side R of the indoor unit 10, the controller 300 may allow the second blade 89 to be in a closed position 89*b* and thus the second blade 89 may close the second outlet 87, and the controller 300 may allow the first blade 88 to be in the open position 88*a* and thus the first blade 88 may open the first outlet 86.

At this time, the controller 300 may additionally control the second expansion valve 62 or the second opening and closing valve 220 to allow the second expansion valve 62 or the second opening and closing valve 220 to be closed to prevent the refrigerant from flowing into the first heat exchanger 51.

In response to one of the first and second outlets 86 and 87 being closed, the air introduced into the inlet 85 may exchange heat with the first and second indoor heat exchangers 51 and 52 while flowing in the inside I of the housing 80, and then the heat-exchanged air may be discharged to the outside through one of the open outlets 86 and 87.

As mentioned above, the controller 300 may operate the first and second blades 88 and 89 by receiving the signal input by the user. In addition, by being connected to an external server, in which a database storing user input values is formed, through a wireless communication such as the Internet, the first and second blades 88 and 89 may be automatically operated in a mode preferred by the user.

As illustrated in FIG. 9, in the heating operation of the air conditioner 1, the air introduced into the indoor unit 10 through the inlet 85 may flow in the inside I of the housing 80 and be heat-exchanged while passing through the second indoor heat exchanger 52, which is arranged on the left side L of the fan 90, and the first indoor heat exchanger 51, which is arranged on the right side R of the fan 90, and thus the air may be changed into high-temperature air that is hot air HA.

In response to the first and second blades 88 and 89 being arranged in the open positions 88*a* and 89*a* for opening the first and second outlets 86 and 87, respectively, the hot air HA that is heat-exchanged may be discharged to the left and right sides L and R of the housing through the first and second outlets 86 and 87. However, the disclosure is not limited thereto, and the hot air HA may be selectively discharged to the left side L or the right side R of the housing 80 in the same way as the cold air CA, as illustrated in FIGS. 7 and 8.

Hereinafter an operation of a reheating and dehumidifying mode of the air conditioner 1 will be described in detail.

Figure 10:
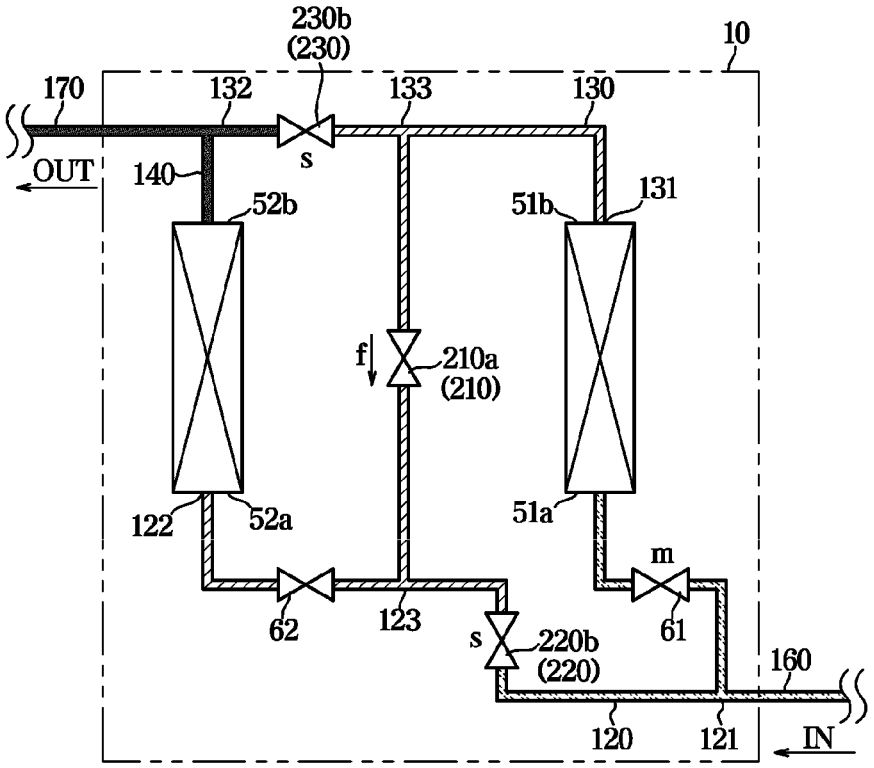
FIG. 10 is a diagram schematically illustrating a configuration of the air conditioner in a reheating and dehumidifying operation of the air conditioner according to an embodiment of the disclosure.
Figure 11:
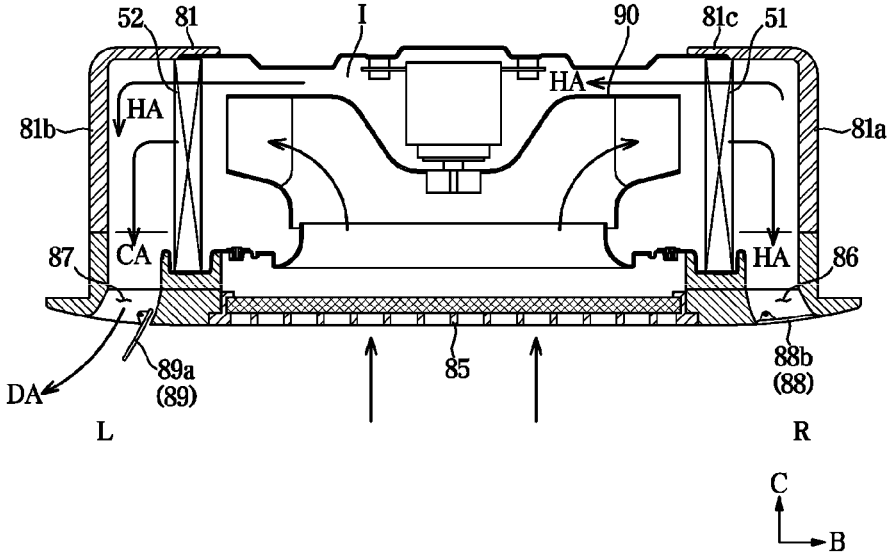
FIG. 11 is a schematic longitudinal-sectional view of the indoor unit of the air conditioner in the reheating and dehumidifying operation of the air conditioner according to an embodiment of the disclosure.
Figure 12:
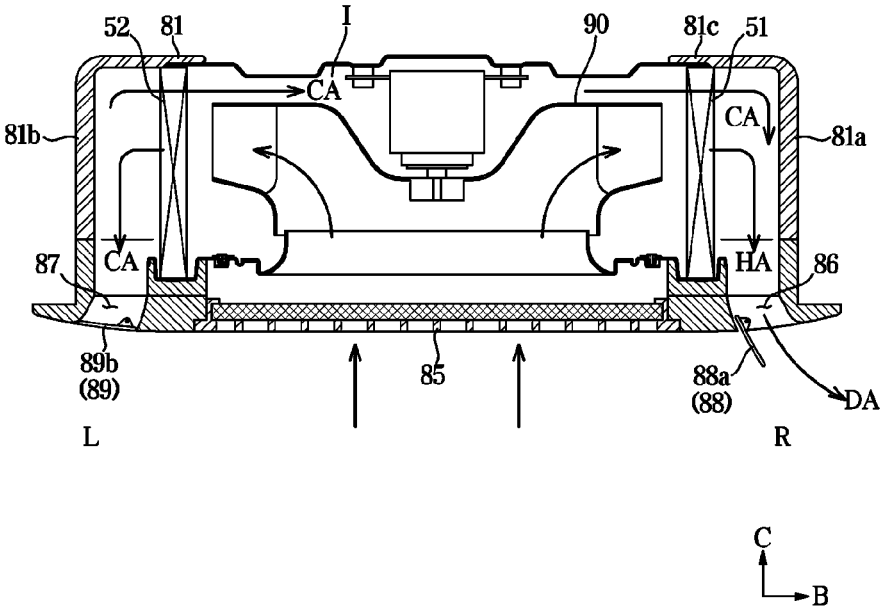
FIG. 12 is a schematic longitudinal-sectional view of the indoor unit of the air conditioner in the reheating and dehumidifying operation of the air conditioner according to an embodiment of the disclosure.

FIG. 10 is a diagram schematically illustrating a configuration of the air conditioner in a reheating and dehumidifying operation of the air conditioner according to an embodiment of the disclosure, FIG. 11 is a schematic longitudinal-sectional view of the indoor unit of the air conditioner in the reheating and dehumidifying operation of the air conditioner according to an embodiment of the disclosure, and FIG. 12 is a schematic longitudinal-sectional view of the indoor unit of the air conditioner in the reheating and dehumidifying operation of the air conditioner according to an embodiment of the disclosure.

As illustrated in FIG. 10, in the reheating and dehumidifying mode of the air conditioner 1, the refrigerant may be discharged from the compressor 30 and introduced into the indoor unit 10 through the first connection pipe 160.

In the reheating and dehumidifying mode of the air conditioner 1, the controller 300 may control the opening and closing valves 210, 220, and 230 to allow the first opening and closing valve 210 to be in the open state 210*a*, and the second opening and closing valve 220 to be in the closed state 220*b*, and the third opening and closing valve 230 to be in the closed state 230*b*.

Further, the controller 300 may control the plurality of flow paths and valves to allow the refrigerant discharged from the compressor 30 to be introduced into the inside of the indoor unit 10 through the first connection pipe 160.

Further, the controller 300 may control the first expansion valve 61 to allow a refrigerant flow cross-sectional area of the first expansion valve 61 to be opened to a maximum limit m. In the cooling and heating modes of the air conditioner 1, the first expansion valve 61 may be provided such that the flow cross-sectional area of the first expansion valve 61 is formed to be equal to a predetermined size or less to allow the refrigerant, which passes through the first expansion valve 61, to be decompressed.

The controller 300 may control the first expansion valve 61 to allow a refrigerant flow cross-sectional area of the first expansion valve 61 in the reheating and dehumidifying mode of the air conditioner 1 to be greater than a refrigerant flow cross-sectional area of the first expansion valve 61 in the cooling and heating modes. For example, the controller 300 may control the first expansion valve 61 to allow the refrigerant flow cross-sectional area of the first expansion valve 61 to be opened to the maximum limit m.

This is to allow the refrigerant, which flows through the first refrigerant pipe 110, to be introduced into the first indoor heat exchanger 51 without being decompressed upon passing through the first expansion valve 61. That is, in the reheating and dehumidifying mode of the air conditioner 1, the first indoor heat exchanger 51 is used as a condenser. This will be described later in detail.

The liquid refrigerant introduced through the first connection pipe 160 may branch and flow into the first refrigerant pipe 110 and the second refrigerant pipe 120.

However, because the second opening and closing valve 220 arranged on the second refrigerant pipe 120 is in the closed state 220*b*, the refrigerant, which is introduced into the second refrigerant pipe 120 through the one end 121 of the second refrigerant pipe 120, may not flow to the other end 122 of the second refrigerant pipe 120 and thus the flow of the refrigerant may be stopped (s) by the second opening and closing valve 220.

Accordingly, the refrigerant introduced into the first connection pipe 160 may flow to the first expansion valve 61 through the first refrigerant pipe 110.

Thereafter, because the refrigerant flow cross-sectional area of the first expansion valve 61 is opened to the maximum limit m, as mentioned above, when the liquid refrigerant passes through the first expansion valve 61, the liquid refrigerant may be introduced into the first indoor heat exchanger 51 through the first expansion valve 61 without decompression, and a phase of the refrigerant may be changed through heat exchange with air introduced into the inside I of the indoor unit 10.

At this time, heat may be generated as the refrigerant is condensed, and while heat exchange is performed with the air passing through the first indoor heat exchanger 51, high-temperature heat may be transferred to the air, and thus air passing through the first indoor heat exchanger 51 may be changed to hot air.

That is, unlike the cooling mode and the heating mode of the air conditioner 1 described above, the refrigerant introduced from the outdoor unit 20 to the indoor unit 10 may flow only to the first indoor heat exchanger 51.

Thereafter, the phase-converted refrigerant may be discharged from the first indoor heat exchanger 51 and introduced into the one end 131 of the third refrigerant pipe 130.

Because the third opening and closing valve 230 is arranged on the third refrigerant pipe 130, and the third opening and closing valve 230 is in the closed state 230*b*, the refrigerant may not flow to the other end 132 of the third refrigerant pipe 130, and thus the flow of the refrigerant may be stopped (s) by the third opening and closing valve 230.

Accordingly, the refrigerant flowing on the third refrigerant pipe 130 may be introduced into the fifth refrigerant pipe 150 through the second connection point 133. Because the third opening and closing valve 230 is arranged between the second connection point 133 and the other end 132 of the third refrigerant pipe 130 as described above, the refrigerant flowing inside the third refrigerant pipe 130 may flow to the fifth refrigerant pipe 150 through the second connection point 133 in response to the third opening and closing valve 230 being in the closed state 230*b*.

Because the first opening and closing valve 210 arranged on the fifth refrigerant pipe 150 is in the open state 210*a*, the refrigerant introduced into the fifth refrigerant pipe 150 may flow (f) from the second connection point 133 to the first connection point 123. That is, the refrigerant introduced into the third refrigerant pipe 130 through the fifth refrigerant pipe 150 may flow into the second refrigerant pipe 120.

In the cooling and heating modes of the air conditioner 1, the first opening and closing valve 210 may be in the closed state 210*b* and thus the flow of the refrigerant may be stopped (s) but in the reheating and dehumidifying mode of the air conditioner 1, the first opening and closing valve 210 may be in the open state 210*a* and thus the refrigerant may flow (f).

Accordingly, the refrigerant may flow from the other end 51*b* of the first indoor heat exchanger 51 to the one end 52*a* of the second indoor heat exchanger 52 through the fifth refrigerant pipe 150.

As described above, the second opening and closing valve 220 may be arranged on the second refrigerant pipe 120, and in the reheating and dehumidifying mode of the air conditioner 1, the second opening and closing valve 220 may be in the closed state 220*b*. In this case, because the second opening and closing valve 220 is arranged between the first connection point 123 and the one end 121 of the second refrigerant pipe 120, the refrigerant, which is introduced from the fifth refrigerant pipe 150 to the second connection point 123, may be prevented or stopped (s) from flowing to the one end 121 of the second refrigerant pipe 120 by the second opening and closing valve 220 but the refrigerant may flow to the other end 122 of the second refrigerant pipe 120.

Accordingly, the refrigerant introduced into the second refrigerant pipe 120 through the fifth refrigerant pipe 150 may be introduced into the second expansion valve 62 arranged between the first connection point 123 and the other end 122 of the second refrigerant pipe 120.

The refrigerant liquefied through the first indoor heat exchanger 51 may be decompressed to a low-temperature and low-pressure state while passing through the second expansion valve 62, and may flow to the second indoor heat exchanger 52.

The refrigerant introduced into the second indoor heat exchanger 52 may be vaporized while exchanging heat with the air of the inside I of the housing 80, and the refrigerant may be introduced into the second connection pipe 170 through the fourth refrigerant pipe 140 and flow to the outdoor unit 20.

The refrigerant flowing through the second indoor heat exchanger 52 may be vaporized through the heat exchange, and thus a temperature of the air passing through the second indoor heat exchanger 52 may be reduced while the refrigerant exchanges heat with the air passing through the second indoor heat exchanger 52.

As the indoor air introduced into the indoor unit 10 flows in the inside I of the housing 80, a portion of the air may pass through the second indoor heat exchanger 52, and accordingly, moisture contained in the indoor air may be condensed by the second indoor heat exchanger 51 and then removed from the air. Accordingly, the moisture in the indoor air introduced into the indoor unit 10 may be dehumidified.

Another portion of the indoor air introduced into the indoor unit 10 may pass through the first indoor heat exchanger 51 while flowing in the inside I of the housing 80, and thus high temperature heat may be transferred to the air passing through the first indoor heat exchanger 51.

The dehumidified air CA passing through the first indoor heat exchanger 51 and the hot air HA passing through the second indoor heat exchanger 52 may flow in the inside I of the housing 80 before being discharged to the outside of the indoor unit 10 through the outlets 86 and 87.

Each of the air CA and HA may be mixed with each other while flowing in the inside I of the housing 80, and accordingly, the air flowing in the inside I of the housing 80 may be changed into reheated and dehumidified air DA in which high temperature heat is transferred to the air in the dehumidified state.

As described above, the first indoor heat exchanger 51 and the second indoor heat exchanger 52 may be connected in series with the compressor 30, and thus the first indoor heat exchanger 51 may be operated as the condenser and the second indoor heat exchanger 52 may be operated as the evaporator.

That is, the first refrigerant pipe 110 and the second refrigerant pipe 120 may be connected in series with the outdoor unit 20. For example, the first and second indoor heat exchangers 51 and 52 may be connected in series with the compressor 30, and accordingly, the first and second indoor heat exchangers 51 and 52 may be operated as the condenser and the evaporator, respectively.

As illustrated in FIGS. 11 and 12, the centrifugal fan 90 may allow the air, which is introduced through the inlet 85, to flow to the first and second indoor heat exchangers 51, and 52 arranged on the left side L and right side R of the fan 90.

As described above, the air introduced into the indoor unit 10 by the fan 90 formed as a centrifugal fan may flow in the radial direction of the rotating shaft of the fan 90. At this time, a portion of the air may flow to the right side R and pass through the first heat exchanger 51, and other portion of the air may flow to the left side L and pass through the second heat exchanger 52.

The air passing through the first indoor heat exchanger 51 may be changed to hot air HA while exchanging heat with the first indoor heat exchanger 51, and the air passing through the second indoor heat exchanger 52 may be changed to cold air CA while exchanging heat with the second indoor heat exchanger 52.

For example, in the air heat-exchanged with the second indoor heat exchanger 52, moisture in the air may be condensed by the second indoor heat exchanger 52 to be removed from the air, and thus the air may be dehumidified.

As described above, the air passing through the first and second indoor heat exchangers 51 and 52 may be mixed with each other while flowing in the inside I of the housing 80 and thus the air may be changed into the reheated and dehumidified air DA.

That is, the air flowing by the fan 90 may be mixed with each other while colliding with the right wall 81*a*, the left wall 81*b*, and the upper wall 81*c* of the upper housing 81, and then the air may be discharged to the outside of the indoor unit 10 through one or both of the outlets 88 and 89.

In the reheating and dehumidifying mode of the air conditioner 1, the controller 300 may control the blades 88, and 89 to allow one of the blades 88, and 89 to open the outlets 86 and 87.

The controller 300 may control the blades 88 and 89 to open one of the first outlet 86 and the second outlet 87 and to close the other of the first outlet 86 and the second outlet 87 to increase the fluidity of the air CA and HA, which is formed at different temperatures by the heat exchangers 51 and 52, so as to allow the air CA and HA to be sufficiently mixed with each other in the inside I of the housing 80.

This is because, when the two outlets 86 and 87 are opened like the heating and cooling mode, the air CA and HA passing through the first indoor heat exchanger 51 and the second indoor heat exchanger 52 may be directly discharged to the outlets 86 and 87 adjacent to each of the heat exchangers 51 and 52 without being mixed with each other.

One or more aspects of the disclosed embodiments may be implemented in the form of a recording medium storing instructions executable by a computer. The instructions may be stored in the form of program code and, when executed by a processor, may generate a program module to perform the operation of the disclosed embodiments. The recording medium may be implemented as a computer-readable recording medium, for example, as a non-transitory computer-readable recording medium.

The computer-readable recording medium includes all kinds of recording media storing instructions which are decipherable by a computer. For example, the computer-readable recording medium may include a ROM, a RAM, a magnetic tape, a magnetic disk, a flash memory, an optical data storage device, and the like.

For example, the controller 300 may include a processor and a memory which stores instruction executable by the processor. The instructions may include instructions which are to control operations of the air conditioner. For example, the instructions may control a position or state of the blades 88 and 89 according to an operating mode of the air conditioner as described herein. For example, the instructions may control a state (e.g., a degree of opening) of the opening and closing valves 210, 220, and 230 according to an operating mode of the air conditioner as described herein. For example, the instructions may control a state (e.g., a degree of opening) of the expansion valves 61, 62 according to an operating mode of the air conditioner as described herein. In addition, a computer-readable recording medium may be distributed among computer systems connected through a network and the computer-readable codes or program instructions may be stored and executed in a decentralized manner.

While the disclosure has been described with reference to example embodiments, it should be understood by those skilled in the art that various changes in form and details may be made without departing from the spirit and scope of the disclosure. Thus, the example embodiments are merely examples and should not be construed as being limiting

What is claimed is:

1. An air conditioner, comprising:

an outdoor unit including a compressor and an outdoor heat exchanger connected to the compressor;

a first indoor heat exchanger configured to receive a refrigerant from the outdoor unit;

a first refrigerant pipe to form at least a portion of a first flow path between a first end of the first indoor heat exchanger and the outdoor unit;

a second indoor heat exchanger configured to receive a refrigerant from the outdoor unit, independently of the first indoor heat exchanger;

a second refrigerant pipe to form at least a portion of a second flow path between a first end of the second indoor heat exchanger and the outdoor unit;

a fan disposed between the first indoor heat exchanger and the second indoor heat exchanger;

a first expansion valve disposed on the first refrigerant pipe;

a second expansion valve disposed on the second refrigerant pipe;

a third refrigerant pipe to form at least a portion of a third flow path between the compressor and a second end of the first indoor heat exchanger;

a fourth refrigerant pipe provided to form at least a portion of a fourth flow path between the compressor and a second end of the second indoor heat exchanger;

a fifth refrigerant pipe;

a first opening and closing valve configured to selectively open and close the fifth refrigerant pipe so as to selectively allow refrigerant to flow between the second refrigerant pipe and the third refrigerant pipe via the fifth refrigerant pipe;

a second opening and closing valve configured to selectively open and close the second refrigerant pipe; and a third opening and closing valve configured to selectively open and close the third refrigerant pipe.

2. The air conditioner of claim 1, wherein the second refrigerant pipe includes a first end branching from the first refrigerant pipe, and a second end connected to the second heat exchanger, and the fifth refrigerant pipe branches from the second refrigerant pipe at a first connection point of the second refrigerant pipe, the second opening and closing valve is disposed between the first end of the second refrigerant pipe and the first connection point of the second refrigerant pipe, and the second expansion valve is disposed between the first connection point of the second refrigerant pipe and the second end of the second refrigerant pipe.

3. The air conditioner of claim 2, wherein the fifth refrigerant pipe branches from the third refrigerant pipe at a second connection point of the third refrigerant pipe, and the second connection point is disposed closer to the first indoor heat exchanger than the third opening and closing valve on the third flow path between the compressor and the second end of the first indoor heat exchanger.

4. The air conditioner of claim 3, wherein in response to the first opening and closing valve being closed, the second opening and closing valve and the third opening and closing valve are opened.

5. The air conditioner of claim 4, wherein in response to a refrigerant flowing from the compressor to the third refrigerant pipe and the fourth refrigerant pipe, the first indoor heat exchanger and the second indoor heat exchanger are connected in parallel to the compressor.

6. The air conditioner of claim 4, wherein in response to a refrigerant flowing from the outdoor heat exchanger to the first refrigerant pipe and the second refrigerant pipe, the first indoor heat exchanger and the second indoor heat exchanger are connected in parallel to the outdoor heat exchanger.

7. The air conditioner of claim 4, further comprising:

a housing configured to cover the first indoor heat exchanger, the second indoor heat exchanger, and the fan, wherein the housing includes:

an inlet, a first outlet disposed adjacent to the first indoor heat exchanger, a second outlet disposed adjacent to the second indoor heat exchanger, a first blade configured to open and close the first outlet, and a second blade configured to open and close the second outlet, and in response to the first opening and closing valve being closed, at least one of the first blade and the second blade is opened.

8. The air conditioner of claim 3, wherein in response to the first opening and closing valve being opened, the second opening and closing valve and the third opening and closing valve are closed.

9. The air conditioner of claim 8, wherein in response to a refrigerant flowing from the compressor to the first refrigerant pipe and the second refrigerant pipe, a refrigerant introduced into the second indoor heat exchanger is supplied to the second indoor heat exchanger via the fifth refrigerant pipe and the second refrigerant pipe.

10. The air conditioner of claim 9, wherein in response to the refrigerant flowing from the compressor to the first refrigerant pipe and the second refrigerant pipe, the first indoor heat exchanger and the second indoor heat exchanger are connected in series with the compressor.

11. The air conditioner of claim 8, further comprising:

a housing configured to cover the first indoor heat exchanger, the second indoor heat exchanger, and the fan, wherein the housing includes:

an inlet, a first outlet disposed adjacent to the first indoor heat exchanger, a second outlet disposed adjacent to the second indoor heat exchanger, a first blade configured to open and close the first outlet, and a second blade configured to open and close the second outlet, and in response to the first opening and closing valve being opened, one of the first blade and the second blade is selectively opened.

12. The air conditioner of claim 1, further comprising:

a housing configured to cover the first indoor heat exchanger, the second indoor heat exchanger, and the fan, wherein the housing includes:

an inlet, a first outlet disposed adjacent to the first indoor heat exchanger, a second outlet disposed adjacent to the second indoor heat exchanger, a first blade configured to open and close the first outlet, and a second blade configured to open and close the second outlet.

13. The air conditioner of claim 1, wherein the fan is disposed between the first indoor heat exchanger and the second heat exchanger in a horizontal direction.

14. The air conditioner of claim 13, wherein the fan is a centrifugal fan including a rotating shaft formed in a vertical direction.

15. The air conditioner of claim 1, wherein the fan includes a plurality of fans, the first indoor heat exchanger is elongated along in a first direction, and the plurality of fans are spaced apart from each other in the first direction.

16. The air conditioner of claim 1, further comprising a controller to control the first opening and closing valve, the second opening and closing valve, and the third opening and closing valve, wherein when the air conditioner is operated in a first mode, the controller is configured to close the first opening and closing valve and to open the second opening and closing valve and the third opening and closing valve, and when the air conditioner is operated in a second mode, the controller is configured to open the first opening and closing valve and to close the second opening and closing valve and the third opening and closing valve.

17. The air conditioner of claim 16, wherein when the air conditioner is operated in the second mode and the controller opens the first opening and closing valve, the second refrigerant pipe is connected to the third refrigerant pipe via the fifth refrigerant pipe, and the first indoor heat exchanger and the second indoor heat exchanger are connected in series with each other.

* * * * *